United States Patent [19]

Kulkarni

[11] Patent Number: 4,892,648

[45] Date of Patent: Jan. 9, 1990

[54] PROCESS FOR BENEFICIATION OF COAL AND ASSOCIATED APPARATUS

[75] Inventor: Amol A. Kulkarni, Pittsburgh, Pa.

[73] Assignee: Viking Systems International, Inc., Pittsburgh, Pa.

[21] Appl. No.: 340,913

[22] Filed: Apr. 20, 1989

[51] Int. Cl.[4] ..... B03D 1/02; B03D 1/10; B03D 1/12

[52] U.S. Cl. ..... 209/164; 209/166; 209/168; 209/170

[58] Field of Search ..... 209/10, 164, 166, 168, 209/170

[56] References Cited

U.S. PATENT DOCUMENTS

| | | | |
|---|---|---|---|
| 2,142,207 | 1/1939 | Price | 209/165 |
| 3,998,604 | 12/1976 | Hinkley . | |
| 4,278,533 | 7/1981 | Hefner | 209/166 |
| 4,474,619 | 10/1984 | Meyer | 209/166 |
| 4,522,628 | 6/1985 | Savins | 209/164 |
| 4,591,431 | 5/1986 | Sinha | 209/164 |
| 4,613,429 | 9/1986 | Chiang et al. . | |
| 4,676,804 | 6/1987 | Miller | 209/166 |
| 4,701,257 | 10/1987 | Hefner | 209/166 |
| 4,732,669 | 3/1988 | Nimerick | 209/166 |
| 4,737,272 | 4/1988 | Szalkowski | 209/164 |

OTHER PUBLICATIONS

Luttrell et al., "Improvements in Recovery and Selectivity with the Microbubble Flotation Process", Proceedings of the 2nd Annual Pittsburgh Coal Conference, Sep. 16-20, 1985, pp. 43-53.

Perry et al., "Flotation", *Chemical Engineer's Handbook*, 6th Edition, pp. 21-46 thru pp. 21-55.

Ahmed et al., "The Effect of Bubble Size on the Rate of Flotation of Fine Particles", *Int. J. Miner. Process.*, 14:195-215.

*Primary Examiner*—David L. Lacey
*Assistant Examiner*—Thomas M. Lithgow
*Attorney, Agent, or Firm*—Arnold B. Silverman

[57] ABSTRACT

A process for removing mineral matter from coal is disclosed. The process involves creating ultrafine coal by pulverizing the coal feed material and mixing it with an aqueous amine solution. The coal/amine solution is fed into a flotation cell and gaseous carbon dioxide is charged into the cell. The carbon dioxide reacts with the amine solution to form bubbles which carry the "clean" coal component of the coal feed material to the top of the cell for subsequent removal from the cell. The bubbles are reduced in size as they move up within the cell. The mineral matter, which is heavier than the clean coal, stays at the bottom of the cell and can be removed separately. The amine and the carbon dioxide used in the process can be recycled. An associated apparatus is also disclosed.

15 Claims, 2 Drawing Sheets

PROCESS FOR BENEFICIATION OF COAL AND ASSOCIATED APPARATUS

BACKGROUND OF THE INVENTION

1. Field Of The Invention

This invention relates to a process for beneficiation of coal and an associated apparatus and more specifically, to the use of gaseous carbon dioxide or gaseous carbon dioxide mixed with air and amines in aqueous coal slurries to remove the undesired mineral matter from the "clean" coal.

2. Description Of The Prior Art

Coal is a vital and plentiful energy source. When coal is burned, however, sulfur dioxide is created. Sulfur dioxide, when mixed with rain water, causes acid rain. The undesirable effects of acid rain are numerous and well known. It is desirable to remove sulfur-bearing as well as ash forming mineral matter from the raw coal in order to use coal in a way that does not adversely effect the environment and coal conversion processes.

One known process for separating coal from mineral matter is set forth in U.S. Pat. No. 4,613,429. Raw coal which consists of "clean coal" and mineral matter is ground to ultrafine sizes (approximately 50 microns) so that the fine mineral matter in the raw coal can be separated from the clean coal. After this, a water slurry of the coal is introduced into a pressurized separation chamber containing liquid carbon dioxide. The liquid carbon dioxide and the liquid water form separate and distinct phases, with the liquid carbon dioxide forming an upper phase and the water forming a lower phase. The concentrated mineral content tends to remain as a slurry in the liquid water phase, while the coal tends to accumulate as a slurry in the liquid carbon dioxide phase.

U.S. Pat. No. 3,998,604 discloses the use of carbon dioxide as a coal flotation agent. This patent does not disclose the use of gaseous carbon dioxide in cooperation with a coal slurry containing amine for the separation of mineral matter from coal. In addition, carbon dioxide does not react during the flotation of coal.

U.S. Pat. No. 2,142,207 discloses a froth flotation process for cleaning coal. Gaseous carbon dioxide is bubbled upwardly through an aqueous slurry of coal to form a froth floating on top of the slurry. As coal has a lower specific gravity than the mineral matter, the coal is carried by the carbon dioxide bubbles to the top of the slurry and the mineral matter is left on the bottom.

In frothing or flotation technology it is desired to use small bubbles and to make the coal as hydrophobic as possible. Small bubble sizes increase the effectiveness of the flotation process because they more selectively capture fine coal particles. Also, because small bubbles (approximately 100–300 microns in diameter) are generally devoid of liquid wakes when moving upwardly through the aqueous slurry, less mineral matter is entrained along with these bubbles than if larger bubbles with associated large wakes are used. This increases the yield of the clean coal which is bubbled to the top of the slurry.

Small bubble sizes have been used in a process called Microbubble Flotation (MBF). See Luttrell, G. H., P. M. Keyser, T. T. Abel, and R. H. Yoon, "Improvements In Recovery And Selectivity With Microbubble Flotation Process", Proceedings Of The Second Annual Pittsburgh Coal Conference, Sept. 16–20, 1985, p. 43. Experimental evidence indicates that improved coal flotation can be attributed to the reduced turbulence behind the small bubbles. The liquid wakes formed behind small bubbles are generally absent and consequently mineral matter, which is hydrophillic in nature, is not entrained as the bubbles carrying the "clean coal" particles move from the bottom to the top of the flotation cell.

It is also desired to increase the hydrophobicity of the coal particles. This will increase the amount of clean coal that can be separated from the mineral matter. In a slurry, however, coal particles are surrounded by a liquid film, thus decreasing the amount of the exposed clean coal surface which in turn adversely affects the separation of the clean coal from the mineral matter.

One known method of shearing off or thinning the liquid film surrounding the clean coal particles and then exposing more of the clean coal's natural surface, is by creating turbulence in the slurry. This turbulence, however, creates large bubbles which have the associated problems discussed hereinabove. Furthermore, once bubble-particle attachment occurs, turbulence in the flotation cell is undesirable because subsequent detachment of the particles from the bubbles will occur. Thus, despite the benefits of turbulence, current MBF cells provide microbubbles which are introduced into the cell into a quiescent suspension at extremely low gas throughputs. Therefore, turbulence associated with large bubbles (approximately 500 microns in diameter) is virtually absent.

Another mode of increasing the hydrophobicity of coal particles is to use chemical agents, such as kerosene. See, Perry, P. H., Green, D., "Flotation", *Chemical Engineer's Handbook,* 6th Edition, pp. 21–46. These chemical agents increase hydrophobicity of coal by adsorption on the coal surface. These chemical agents, however, tend to have a deleterious effect on the performance of the process, because they tend to agglomerate coal. Agglomeration increases the effective particle size of the coal and thus, can impact the performance of frothing or flotation processes.

A related problem is maintaining a uniform dispersion of the microbubbles in the slurry. Though microbubbles are introduced in MBF cells, there is an inherent tendency towards the formation of larger bubbles in the cell. As bubbles rise to the surface in an aqueous slurry, they tend to grow in size due to decreased hydrostatic pressure. Also, because of the high bubble density associated with microbubbles, the liquid film between adjacent bubbles tends to collapse resulting in coalescence of a series of the smaller bubbles into larger bubbles. In aqueous slurries, the coalescence phenomena is further promoted due to the presence of solid particles. Use of surfactants prevents coalescence to a large extent but does not eliminate it.

In spite of these prior art teachings, there remains a need for an improved flotation process that will accomplish the separation of mineral matter from mineral ore in an effective manner.

SUMMARY OF THE INVENTION

The present invention has solved the above mentioned problems. The process of the invention involves mixing pulverized feed coal with an aqueous amine solution to create an aqueous slurry and introducing the slurry into the lower portion of a cell. The lower portion of the cell is then charged so as to create bubbles and so as to create turbulence in the aqueous slurry. The coal particles attach to the bubbles, and the bubble/coal particles rise from the lower portion of the cell to the upper portion of the cell. As the bubbles rise, their size is reduced due to the reaction of the gas with the amine solution. The coal particles are then removed from the upper portion of the cell. The concentrated mineral matter remains in the lower portion of the cell and is withdrawn from the cell. An associated apparatus is also disclosed.

It is an object of the invention to provide an improved froth flotation process for separating coal from mineral matter.

It is a further object of the invention to utilize carbon dioxide and amines in a froth flotation process.

It is a further object of the invention to create in situ microbubbles from large bubbles by the absorption of carbon dioxide accompanied by a chemical reaction.

It is a further object of the invention to create in the flotation cell a zone of turbulence and a zone wherein turbulence is virtually absent.

It is a further object of the invention to recover the carbon dioxide and amines by steam stripping.

It is a further object to have a process that economically and efficiently beneficiates coal.

It is a further object of the invention to improve the hydrophobicity of the coal and thus its flotability.

These and other objects of the invention will be more fully understood from the following description of the invention with reference to the drawing appended to this application.

DESCRIPTION OF THE PREFERRED EMBODIMENTS

The present invention for beneficiating coal involves absorbing gaseous carbon dioxide or carbon dioxide mixed with air bubbled in coal slurried with aqueous solutions of primary or secondary amines in a simple bubble column, wherein carbon dioxide absorption is accomplished by a desired chemical reaction. The coal particles are captured by the bubbles and conveyed to the top of the cell have a diminished mineral content as compared to the feed coal, while the solids which tend to accumulate in the aqueous phase have an elevated mineral content as compared to the feed coal.

The process is benefited by the chemical reaction between carbon dioxide and amines. The reaction converts larger carbon dioxide bubbles associated with turbulence in situ into microbubbles wherein turbulence and liquid wakes are virtually absent.

Figure 1:
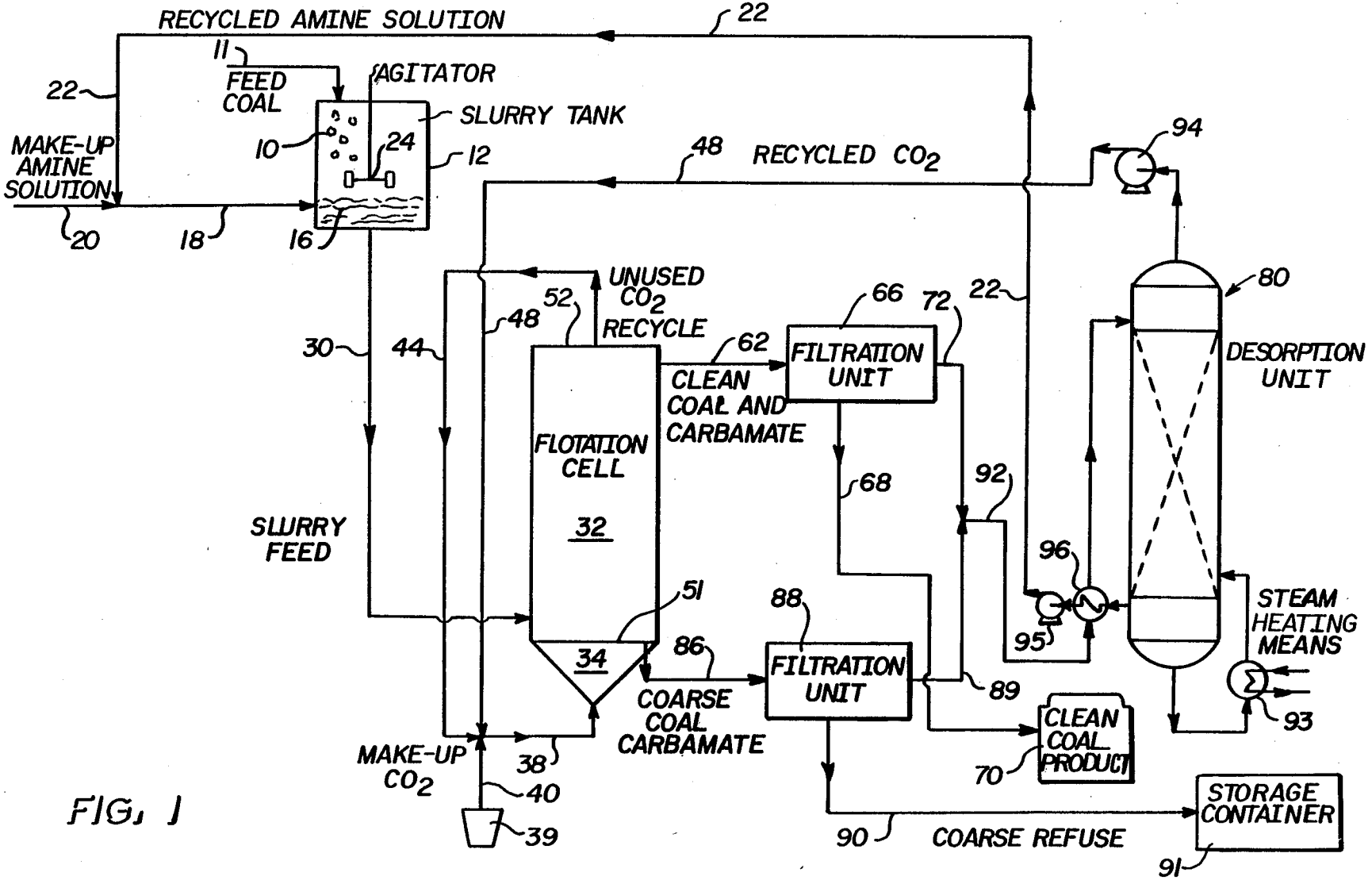
FIG. 1 is a schematic flow diagram showing the process of the invention.

Referring now more particularly to FIG. 1, a flow diagram of a preferred continuous process of the invention will be discussed. Pulverized feed coal 10 is charged into a slurry tank 12 by line 11. An aqueous amine solution 16 is also charged into tank 12 through line 18. The aqueous amine solution includes a make-up amine solution from line 20 and recycled amine solution from line 22. The slurry tank 12 is preferably provided with an agitator 24 which facilitates intimate mixing of the pulverized feed coal 10 with the aqueous amine solution to produce a coal slurry.

The feed coal 10 is preferably first ground to an ultrafine particle size such as, for example, smaller than about 200 mesh. As improved clean coal yields are achieved by reducing the particle size of the feed coal, the present invention can be applied to various types and grades of feed coal 10 such as, for example, bituminous, sub-bituminous, anthracite, lignite, peat, and coal fines.

The coal slurry is then fed through line 30 into a flotation cell 32 including a gas distributor 34. If desired, a Denver cell or Agitair machine or simple bubble column can be used as a flotation cell. Carbon dioxide gas enters the flotation cell 32 through line 38 and the gas distribution portion 34. The carbon dioxide preferably comes from three different sources (i) an outside source 39 such as a tank of gas, through line 40, (ii) unused carbon dioxide gas recycled from the top of the flotation cell 32, through line 44, and (iii) recycled carbon dioxide from the desorption unit 80 (described hereinbelow) through line 48.

The carbon dioxide gas is charged through the gas distributor 34 into the bottom portion 51 of the flotation cell 32 and allowed to bubble upwardly to the top portion 52 of the flotation cell 32. The unused carbon dioxide is recycled back to the flotation cell 32 through line 44 as was discussed hereinabove.

The bubbling action carries the "clean coal" product to the top 52 of the flotation cell 32. The clean coal product, along with the carbamate solution (discussed hereinbelow) produced by the amine and coal mixture, is drawn off through line 62 and delivered to a filtration unit 66. The clean coal product is separated from the carbamate in the filtration unit 66, with the clean coal product being sent through line 68 to storage tank 70 and the carbamate being sent through line 72 to, eventually, the desorption unit 80.

The larger coarse mineral matter particles of the coal slurry remain at the bottom 51 of the flotation cell 32. These particles and the carbamate solution are carried off by line 86 to a filtration unit 88 wherein the carbamate is separated and then fed into the desorption unit 80 through line 89. The coarse refuse is taken away from the filtration unit 88 by line 90 and delivered to a storage container 91.

The desorption unit 80 thus receives carbamate solution from filtration unit 66 and filtration unit 88 through lines 72 and 89 respectively. Lines 72 and 89 join to form line 92. In the desorption unit 80, the carbamate is decomposed into carbon dioxide and the amine by steam heating means 93. The carbon dioxide is drawn from the top of the desorption unit 80 and delivered, by pump means 94, through line 48 back to the flotation cell 32. The aqueous amine solution is drawn from the bottom of the desorption unit 80 and pumped by pump means 95, through line 22 for recycling back to the slurry tank 12. The hot aqueous amine solution withdrawn from the desorption unit 80 through line 22 is passed through a heat exchanger 96 to heat the liquor entering the desorption unit through line 92.

Figure 2:
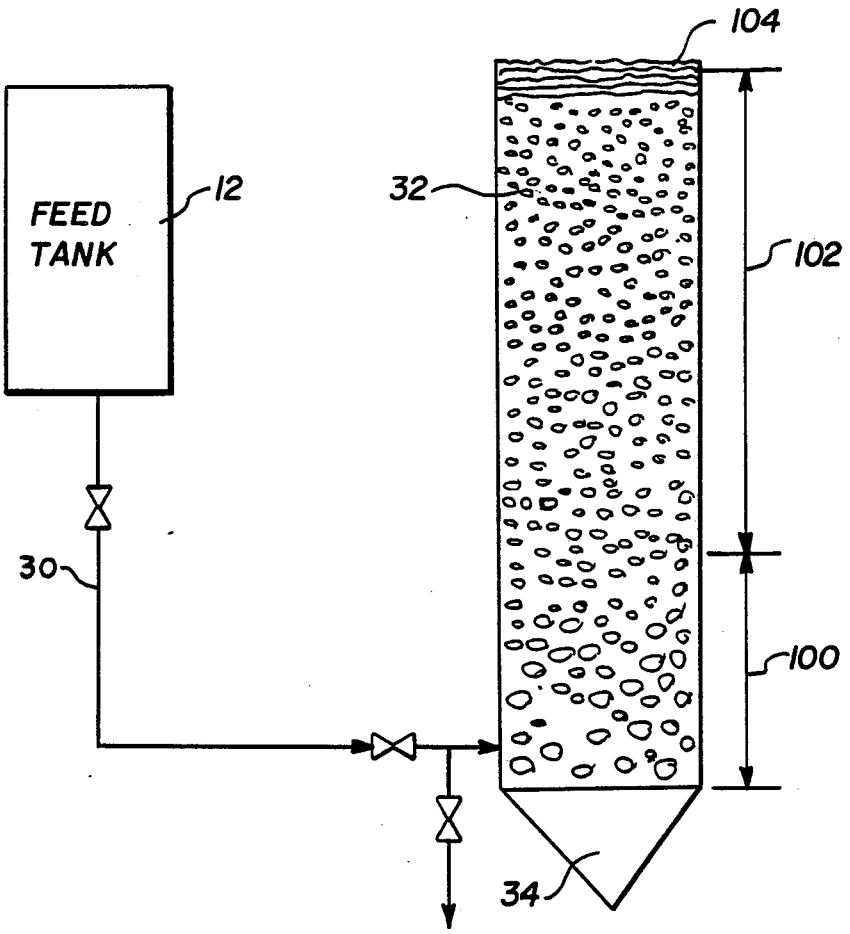
FIG. 2 is a schematic illustration of bubble behavior in a process of the present invention.

FIG. 2 is a more detailed schematic illustration of the apparatus and bubble behavior in the flotation cell 32. Carbon dioxide is bubbled upwardly through the coal slurry prepared in the aqueous solution in the slurry tank 12 and transferred to the bottom of the flotation cell by line 30.

A zone 100 of large bubbles associated with high turbulence is disposed near the bottom of the cell 32 and in the immediate vicinity of the gas distributor 34. A zone 102 of smaller bubbles of decreased turbulence is disposed above zone 102 and spaced from the distributor 34 and towards the top 104 of the cell. Because of the introduction of the gas into the lower zone 100, the bubbles in zone 100 create high turbulence which tends to shear or thin the liquid film on the coal particles. This increases the exposure of the natural surface area of the coal particle leading to better particle-bubble attachment. The zone of small bubbles 102 (with associated low turbulence) has bubbles which carry the coal particles to the top of the cell 32. The small bubbles and low turbulence minimize liquid wakes which in turn, resists entrainment of undesired mineral matter up the flotation cell. The relative heights of the zones 100 and 102 will depend upon the operating conditions, i.e., temperature, amine concentration and gas flow rates, for example.

The large bubbles will generally have a diameter of about 0.3 to 3.0 mm and preferably 0.5 to 1.5 mm. The small bubbles will generally have a diameter of about 0.1 to 0.3 mm with 0.1 to 0.2 mm being preferred. Thus, the bubbles will be reduced by about 50 to 90% as they rise from zone 100 to 102.

Among the amines that are preferred are amines selected from the group consisting of monoethanolamine (MEA), diethanolamine (DEA), and diisopropylamine (DIPA). Carbon dioxide reacts readily with the amine at near ambient conditions to form carbamate which is water soluble and is present in solution in ionic form. Both carbon dioxide and the amine can be easily recovered by heating or steam stripping the aqueous solution containing the carbamate at temperatures of between 80° C. and 100° C.

Waste steam is generally available in most facilities. Both fugitive carbon dioxide and the amines pose no environmental problem. The process, therefore, offers an inexpensive way of beneficiating ultrafine coals, as carbon dioxide is available inexpensively in large quantities or can be generated on-site in a coal preparation plant by burning coal.

The extent to which carbon dioxide will dissolve in water is limited by its saturation solubility at the operating temperature and pressure. Consequently, the extent to which the bubble size can be decreased is also limited. Absorption of carbon dioxide in aqueous solutions of amines, however, produces a chemical reaction which converts the dissolved carbon dioxide and amine to form a carbamate which is present in solution in its ionic form. A greater amount of carbon dioxide therefore can be absorbed into the solution because the chemical reaction, in essence, destroys the carbon dioxide dissolved in the solution. As opposed to physical absorption of carbon dioxide in water, absorption of carbon dioxide in aqueous amine solutions is enhanced due to chemical reaction.

The chemical reaction between carbon dioxide and amine may be given by the equations:

Primary Amines:

$$\begin{array}{l} RNH_2 + CO_2 \rightleftharpoons RNHCOO^- + H^+ \\ RNH_2 + H^+ \rightleftharpoons RNH_3^+ \\ \hline 2RNH_2 + CO_2 \rightleftharpoons RNHCOO^- + RNH_3 \end{array}$$

Secondary Amines:

-continued $$\begin{array}{l} R_2NH + CO_2 \rightleftharpoons R_2NCOO^- + H^+ \\ R_2NH + H^+ \rightleftharpoons R_2NH_2^+ \\ \hline 2R_2NH + CO_2 \rightleftharpoons R_2NCOO^- + R_2NH_2^+ \end{array}$$

In these equations, for both MEA (primary amine) and DEA (secondary amine), $R=C_2H_4OH^-$; for DIPA, $R=C_3H_7^-$.

Dissolved carbon dioxide reacts with amines at temperatures as low as 6° C. The reaction between carbon dioxide and MEA is a second order reaction—first order in carbon dioxide and first order with respect to the amine. The reaction between carbon dioxide and DEA is first order with respect to carbon dioxide, but the order with respect to the amine is either one or two depending upon the reaction conditions. Consequently, absorption of carbon dioxide in amines can be manipulated and the extent of the reaction controlled by variation in both the pressure of carbon dioxide and the concentration of the amine, which in turn will allow for the control of the bubble size.

An increase in the concentration of the amine, and/or partial pressure of carbon dioxide, and/or temperature increases the rate of the reaction between dissolved carbon dioxide and the amine, which in turn causes greater amounts of carbon dioxide to be absorbed into the solution from the bubbles. Therefore, as the bubbles move upwards through the suspension, rather than increasing in size either due to coalescence or a decrease in the hydrostatic pressure, the bubble size would decrease or remain constant depending on how one chooses to control the reaction medium.

Also other conditions in the flotation cell such as temperature, initial bubble size and residence time of the bubbles can be used to control the size of the bubbles. The initial bubble size is also determined by the nature of the gas distributor in the cell. Gas distributors such as porous plates, perorated plates or ejector nozzles are preferred. The residence time of the bubbles can be manipulated by changing the cell height and initial size of the bubbles.

The amine concentration in the aqueous solution will generally be in the range of 0.015–5 gmole/liter, depending on the type of amine used and the conversion of carbon dioxide desired. The lower concentrations are preferred for economic reasons. The partial pressure of carbon dioxide would be in the range of about 0.1–1 atmosphere. Temperature in the flotation cell would be in the range of about 5°–35° C., though the prevailing ambient temperature is the preferred temperature. Coal concentrations that would be employed would be typical of other froth flotation processes, that is, 5–10 weight percent of the raw coal.

The decomposition of carbamate to carbon dioxide and amine, that is, the reverse reaction described in the equations hereinbefore set forth is favored at higher temperatures namely about 80°–100° C. Consequently, the slurry withdrawn from the flotation cell 32 will be dewatered by filtration units 66 and 88 and the solution heated or steam stripped by stripping means 93 to recover the amine and the carbon dioxide.

EXAMPLE

Tests were performed on a Middle Kittaning coal in a batch bubble column made of glass and the clean coal fraction skimmed from the top at regular intervals was analyzed for ash content. The ash content of the feed coal was 7.21%. The typical experimental conditions employed were:

| | |
|---|---|
| Temperature, °C. | 15–30 |
| Aqueous slurry concentration, wt % of solid | 8–10 |
| Amine concentration (MEA), gmole/liter | .05–2.0 |
| Particle size | −200 mesh |
| Pressure, atm | 1 |
| Time, sec | Up to 2400 |
| Ash content, wt % (feed coal) | 7.21% |

Table 1 shows the ash content of the "clean coal" product skimmed off from the top of the liquid and the feed coal and the percent ash reduction during one test.

TABLE 1

| Sample Coal | Feed Slurry Concentration (wt %) | Contact Time (sec) | Ash (wt %) | % Ash Reduction Clean Coal Product |
|---|---|---|---|---|
| Middle Kittaning | 8.92 | 0 | 7.21 | |
| | | 600 | 3.382 | 53.09 |
| | | 1200 | 4.437 | 38.46 |
| | | 2400 | 5.756 | 20.17 |
| MEA concentration 1.802 gmole/liter | | | | |

It may be noted that although the concept has been described for the beneficiation of ultrafine coals, it could be used for upgrading other mineral ores. Additionally, other amines which are more reactive than those outlined above may also be suitable for use in the process.

Whereas a particular embodiment of the invention has been described hereinabove, for purposes of illustration, it would be evident to those skilled in the art that numerous variations of the details may be made without departing from the invention as defined in the appended claims.

I claim:

1. A process for separating coal particles from mineral matter in a raw coal feed material containing said coal particles and said mineral matter comprising the steps of mixing said raw coal feed material with an aqueous amine solution to create an aqueous slurry, introducing said aqueous slurry into a lower portion of a flotation cell, charging said lower portion of said cell with gas containing carbon dioxide so as to create bubbles, creating turbulence in said aqueous slurry by said charging of said gas, so that said coal particles attach to said bubbles, reducing the size of said bubbles by about 50% to 90% as said bubbles rise from said lower portion of said cell to said upper portion of said cell by operating the cell under conditions such that the carbon dioxide chemically reacts with said amine solution, transporting said coal particles by means of said rising bubbles to an upper portion of said cell, and removing said coal particles from said upper portion of said cell.

2. The process of claim 1, including controlling the size of said bubbles by manipulating at least one of the group consisting of the concentration of said amine solution, the partial pressure of the carbon dioxide, the height of the cell and the temperature in the cell.

3. The process of claim 2, wherein employing as said amine solution a solution selected from the group consisting of monoethanolamine, diethanolamine or diisopropylamine.

4. The process of claim 3, wherein employing as said amine solution a solution having an amine concentration of about 0.015 to 5 gmole/-liter.

5. The process of claim 4, wherein employing as said raw coal feed material a material selected from the group consisting of bituminous coal, sub-bituminous coal, lignite coal, anthracite coal and peat, and before mixing said raw coal feed material with said amine solution, grinding said raw coal feed material to ultrafine size.

6. The process of claim 5, including grinding said raw coal feed material to less than about 200 mesh size.

7. The process of claim 2, wherein, said gas comprising a mixture of carbon dioxide and ambient air and during said charging step the partial pressure of said carbon dioxide is about 0.1 to 1 atmosphere.

8. The process of claim 7, wherein said carbon dioxide is charged at a partial pressure of about 1 atmosphere.

9. The process of claim 2, wherein said charging of said gas comprises charging at such a condition that said bubbles at said lower portion of said cell are about 0.3 mm to 3 mm in diameter.

10. The process of claim 9, wherein said reducing of said bubbles comprises reducing at such a condition that said bubbles at said upper portion of said cell are about 0.1 mm to 0.3 mm in diameter.

11. The process of claim 10, wherein said charging of said gas comprises charging at such a condition that said bubbles at said lower portion of said cell are about 0.5 mm to 1.5 mm.

12. The process of claim 11, wherein said reducing of said bubbles comprises reducing at such a condition that said bubbles at said upper portion of said cell are about 0.1 mm to 0.2 mm.

13. The process of claim 1, including after removing said coal particles from said upper portion of said cell, removing said aqueous slurry containing mineral matter and said amine solution from said cell, separating said aqueous slurry from said mineral matter, steam stripping said aqueous slurry to recover said amine solution, and reusing said stripped amine solution in said process.

14. The process of claim 13, including recovering a first amount of unused gas containing carbon dioxide from said gas charged into said cell and reusing said first amount of unused gas in said process.

15. The process of claim 14, including recovering a second amount of gas containing carbon dioxide from said steam stripping of said aqueous slurry and reusing said second amount of gas in said process.

* * * * *